US008714787B2

(12) United States Patent
McGehee et al.

(10) Patent No.: US 8,714,787 B2
(45) Date of Patent: May 6, 2014

(54) LOW BAY LIGHTING APPARATUS

(76) Inventors: Michael Eugene McGehee, Jarrettsville, MD (US); John Thomas Adinolfi, Milltown, NJ (US)

( * ) Notice: Subject to any disclaimer, the term of this patent is extended or adjusted under 35 U.S.C. 154(b) by 0 days.

(21) Appl. No.: 13/314,278

(22) Filed: Dec. 8, 2011

(65) Prior Publication Data

US 2013/0148354 A1 Jun. 13, 2013

Related U.S. Application Data

(60) Provisional application No. 61/420,864, filed on Dec. 8, 2010.

(51) Int. Cl.

| | |
|---|---|
| ***F21V 21/00*** | (2006.01) |
| ***F21V 29/00*** | (2006.01) |
| ***F21V 17/00*** | (2006.01) |
| ***F21S 4/00*** | (2006.01) |
| ***F21S 8/06*** | (2006.01) |
| ***F21S 8/00*** | (2006.01) |

(52) U.S. Cl.

USPC ..... 362/388; 362/373; 362/374; 362/375; 362/249.02; 362/404; 362/406; 362/147; 362/249.03

(58) Field of Classification Search

USPC ..... 362/373, 249.02, 388, 249.03, 221, 362/222, 374, 375, 404, 407, 408, 147

See application file for complete search history.

(56) References Cited

U.S. PATENT DOCUMENTS

| | | | | |
|---|---|---|---|---|
| 2,597,875 | A * | 5/1952 | Kruger | 362/217.05 |
| 5,941,625 | A * | 8/1999 | Morand | 362/148 |
| 6,450,668 | B1 * | 9/2002 | Kotloff | 362/269 |
| 6,527,422 | B1 * | 3/2003 | Hutchison | 362/373 |
| 7,686,484 | B2 * | 3/2010 | Heiking et al. | 362/375 |
| 7,771,087 | B2 * | 8/2010 | Wilcox et al. | 362/294 |
| 7,946,738 | B2 * | 5/2011 | Fowler et al. | 362/374 |
| 8,100,551 | B2 * | 1/2012 | Mayfield et al. | 362/223 |
| 2009/0141494 | A1 * | 6/2009 | Zhang et al. | 362/249.03 |
| 2010/0061095 | A1 * | 3/2010 | Hoffmann | 362/235 |

* cited by examiner

*Primary Examiner* — Ismael Negron
*Assistant Examiner* — William N Harris
(74) *Attorney, Agent, or Firm* — NSIP Law

(57) ABSTRACT

There is provided a low bay lighting apparatus secured to an elevated horizontal surface. The low bay lighting apparatus including a light fixture and a mounting bracket to which the light fixture is to be removable attached. The light fixture includes a plurality of posts disposed on opposite ends of opposing outer side surfaces of the light fixture. The mounting bracket includes a plurality of slots configured to mate respectively with the plurality of posts to removably secure the light fixture to the mounting bracket. When being serviced, the light fixture is configured to freely hang from a first set of slots.

17 Claims, 12 Drawing Sheets

LOW BAY LIGHTING APPARATUS

CROSS-REFERENCE TO RELATED APPLICATION

This application claims the benefit under 35 U.S.C. §119 (e) of U.S. Provisional Application No. 61/420,864, filed on Dec. 8, 2010, in the United States Patent and Trademark Office, the entire disclosure of which is incorporated herein by reference for all purposes.

BACKGROUND

1. Field

The following description relates to general, commercial, and industrial illumination, and, more particularly, to a low bay lighting apparatus configured to illuminate general, commercial, and industrial environments while being serviceable on site without disconnection of electricity or removal of the low bay lighting apparatus from its affixed location.

2. Description of the Related Art

Low bay lighting solutions are implemented in a variety of general purpose, industrial, and commercial illumination environments, such as the illumination of parking structures, transportation garages, warehouses, assembly areas, gyms, hangars, retail spaces, showrooms, and the like.

Low bay lighting applications conventionally utilize metal halide lamps. Metal halide lamps are relatively small in size and high in light output. However, metal halide lamps require extremely high pressures to operate, and generate high temperatures during operation. Thus, special fixtures are required to compensate for the extremely high pressures and temperatures. Even so, due to the high stress of operation, metal halide lamps are often subject to explosions and, thus, have the potential to cause substantial injury in the workplace or during maintenance. In addition, in order to make metal halide lamps safe to operate in everyday illumination environments, the special fixtures that metal halide lamps require necessarily sacrifice convenience and ease of installation and maintenance in order to provide the utmost safety for those who work around and maintain the metal halide lamps.

In view of the various disadvantages of metal halide lamps, low bay lighting solutions are being developed that utilize light emitting diodes (LEDs). While a significant amount of LEDs are required to equal the lighting output of metal halide lamps, techniques in optimizing LEDs for use in low bay and other illumination applications have been successful. In addition, implementations of LEDs in low bay lighting applications have been found to be much safer than implementations of metal halide lamps in low bay lighting applications. Further, low bay lighting applications that implement LEDs consume much less power than a typical metal halide lamp.

However, low bay lighting applications implementing LEDs still suffer from many drawbacks. For example, related low bay lighting applications that implement LED technology do not take into account heat buildups caused by boundary conditions created within the lamp that creating high thermal resistances.

Further, conventional low bay fixtures designed to implement LEDs are one-piece sealed units. These one-piece sealed units make component or LED replacement extremely difficult without compromising seals and ratings. Compromise of those seals and ratings often serve to invalidate the warranty of the fixture.

In addition, conventional low bay fixtures implementing LEDs are generally unable to be maintained in the field and must be removed to be serviced. Moreover, the subsequent removal of the conventional low bay fixtures implementing LEDs requires an electrical supply to be disconnected or shut down. Thus, in order to service a single related low bay fixture, electricity supplied to a numerous amount of perfectly functioning fixtures must be terminated. This termination of electricity can sometimes require a significant amount of time and participation of multiple individuals communicating over mobile devices in order to efficient service the low bay fixture.

SUMMARY

In one general aspect, a low bay lighting apparatus secured to an elevated horizontal surface is provided, the low bay lighting apparatus including a light fixture, including a modular light source configured to illuminate areas disposed beneath the light fixture, a modular power supply configured to provide power to the modular light source, and a plurality of posts disposed on planes that are perpendicular to a long side of the modular light source and on opposite ends of opposing outer side surfaces of the light fixture, and a mounting bracket secured to the elevated horizontal surface, the mounting bracket including a plurality of slots configured to mate respectively with the plurality of posts to removably secure the light fixture to the mounting bracket. When being serviced, the light fixture is configured to freely hang from one portion of the plurality of slots respectively via one portion of the plurality of posts disposed at one of the opposite ends of the opposing outer side surface of the light fixture.

The general aspect of the apparatus may further provide that the modular light source includes a plurality of lighting modules, each of the lighting modules comprising a plurality of light emitting diodes (LEDs).

The general aspect of the apparatus may further provide a plurality of spring clips configured to secure the modular light source to the light fixture and release the modular light source from the light fixture when the plurality of slots of the mounting bracket are mated respectively with the plurality of posts of the light fixture.

The general aspect of the apparatus may further provide that the modular light source is secured from and released to an outer periphery of the light fixture.

The general aspect of the apparatus may further provide a plurality of mating locking clips configured to prevent the plurality of spring clips from being operated to release the modular light source from the light fixture when the mating locking clips are inserted into the spring clips.

The general aspect of the apparatus may further provide that the one portion of the plurality of slots includes a plurality of inverted T slots disposed on one end of opposing outer side surfaces of the mounting bracket, the plurality of inverted T slots being configured to accept the one portion of the plurality of posts through a vertically slanted portion of the inverted T slots, enable slidable adjustment and resting of the one portion of the plurality of posts on a horizontal portion of the inverted T slots, and support the one portion of the plurality of posts to enable the light fixture to freely hang from the horizontal portion of the inverted T slots.

The general aspect of the apparatus may further provide that the plurality of slots includes a plurality of straight slots disposed on an opposite end of the opposing outer side surfaces of the mounting bracket from the plurality of inverted T slots, the plurality of straight slots being configured to accept an other portion of the plurality of posts through a vertical opening of the straight slots, the vertical opening being disposed at a horizontal edge portion of the other end of the opposing outer side surfaces of the mounting bracket, the other portion of the plurality of posts being disposed on an other one of the opposite ends of the opposing outer side surfaces of the light fixture from the one portion of the plurality of posts, and enable slidable adjustment and resting of the other portion of the plurality of posts on a horizontal portion of the straight slots, and support the other portion of the plurality of posts to enable the light fixture to be supported horizontally by the plurality of slots.

The general aspect of the apparatus may further provide that the light fixture and the mounting bracket further include one or more locking fastener receivers configured to accept a fastener to prevent the plurality of posts from sliding in the plurality of slots, the locking fastener receivers of the light fixture having a location that corresponds with a location of the locking fastener receivers of the mounting bracket.

The general aspect of the apparatus may further provide a watertight hand-operated power cord configured to supply the modular power supply with electricity, and a watertight hand-operated connection cord configured to connect the modular light source to the modular power supply, and enable a disconnection of the modular light source from the modular power supply while modular power supply is being supplied with electricity.

The general aspect of the apparatus may further provide that the watertight hand-operated power cord, the watertight hand-operated connector cord, the modular power supply, and the modular light source are configured to be water tight to a submergible rating of IP67.

The general aspect of the apparatus may further provide that the modular light source is further configured to be removed without terminating an electricity supply to the modular power source.

In another general aspect, a low bay lighting apparatus is provided, the low bay lighting apparatus including a mounting bracket configured to hang from an elevated horizontal position, the mounting bracket including a plurality of slots, a light fixture configured to hang from the mounting bracket, the light fixture including a plurality of posts configured to mate with the plurality of slots of the mounting bracket to secure the light fixture to the mounting bracket. When a portion of the plurality of posts is not mated with a corresponding portion of the plurality of slots, an other portion of the plurality of posts is configured to rotate in a corresponding other portion of the plurality of slots, and support the light fixture in a freely hanging position that is substantially perpendicular to a position of the mounting bracket.

The general aspect of the apparatus may further provide a plurality of modular light emitting diode (LED) boards disposed in the light fixture, the plurality of modular LED boards including a plurality of spring clips configured to attach the modular LED boards to the light fixture without using tools.

The general aspect of the apparatus may further provide that the mounting bracket further includes a plurality of louvers configured to convect heat generated by the light fixture into ambient air outside of the low bay lighting apparatus.

The general aspect of the apparatus may further provide a modular power supply configured to supply power to the plurality of modular LED boards, the modular power supply and the plurality of modular LED boards being sealed and watertight, a watertight hand-operated power cord configured to connect the modular power supply to a source of electricity, and a plurality of watertight hand-operated connector cords configured to supply the plurality of modular LED boards with power from the modular power supply. The watertight power cord and the plurality of watertight connector cords are further configured to prevent water damage to the plurality of modular LED boards and the modular power supply, and allow connection to and disconnection from the modular power supply and the plurality of modular LED boards without using tools or termination of the source of electricity.

The general aspect of the apparatus may further provide a plurality of mating locking clips configured to lock the spring clips when inserted in the spring clips.

In another general aspect, there is provided a low bay lighting apparatus secured to an elevated horizontal surface, the low bay lighting apparatus including a lighting module removably secured to a light fixture, the lighting module including one or more light emitting diodes (LEDs), posts disposed on opposite ends of opposing outer side surfaces of the light fixture, a mounting bracket secured to the elevated horizontal surface, the mounting bracket including slots configured to mate respectively with the posts to removably secure the light fixture to the mounting bracket, and spring clips configured to secure the lighting module to the light fixture and release the lighting module from the light fixture.

The general aspect of the apparatus may further provide that the spring clips are further configured to secure the lighting module from and release the lighting module to an external periphery of the light fixture.

The general aspect of the apparatus may further provide mating locking clips configured to mate with portions of the spring clips disposed in an internal periphery of the light fixture to prevent operation of the spring clips to release the lighting module to an external periphery of the light fixture.

The general aspect of the apparatus may further provide that the mating locking clips mate with the portions of the spring clips disposed in the internal periphery of the light fixture when the light fixture is freely hanging from a pair of the slots respectively via a pair of the posts disposed at one of the opposite ends of the opposing outer side surface of the light fixture.

Other features and aspects may be apparent from the following detailed description, the drawings, and the claims.

Figure 1:
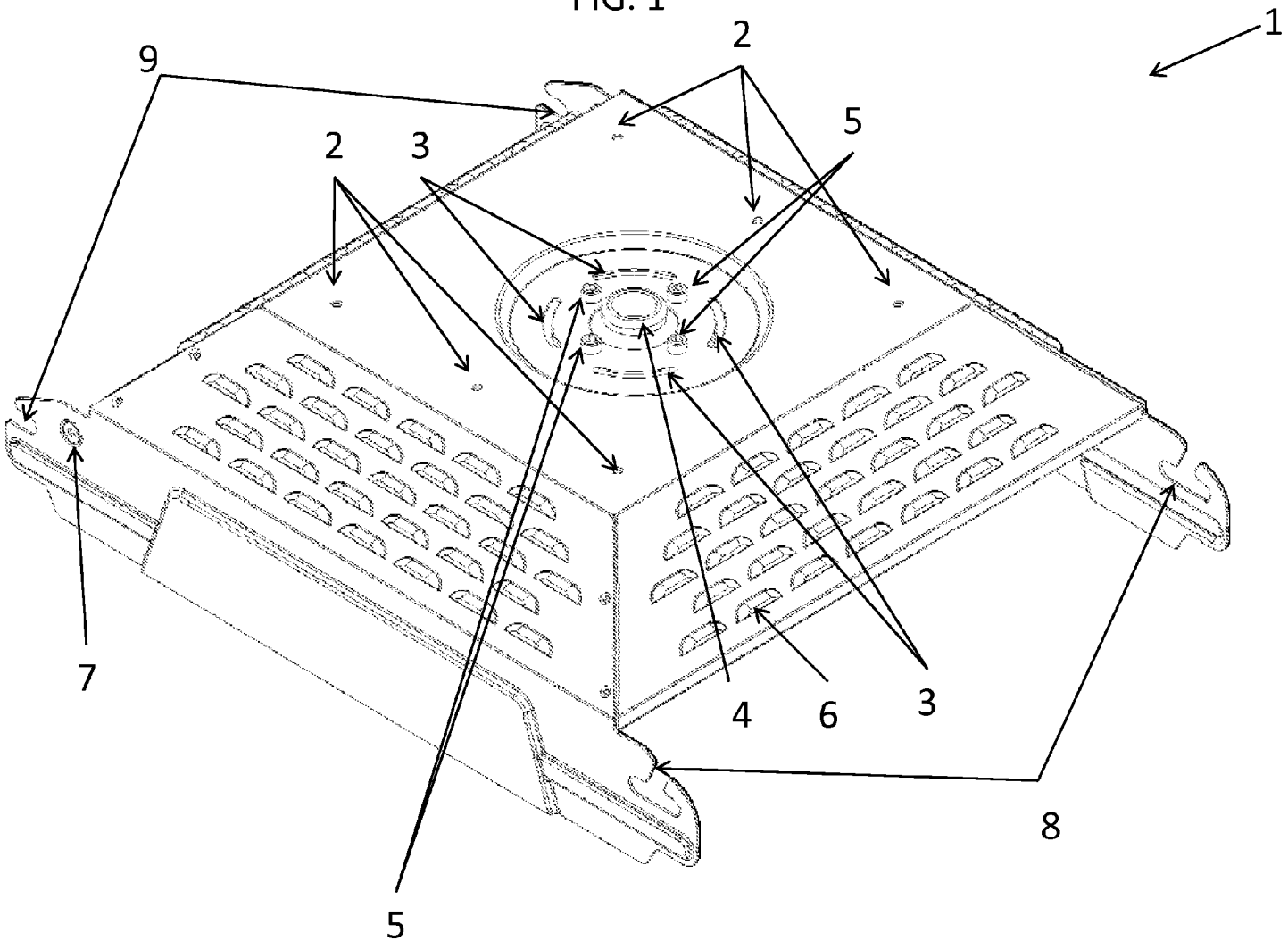
FIG. 1 illustrates a plan view example of a mounting bracket of a low bay lighting apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 2:
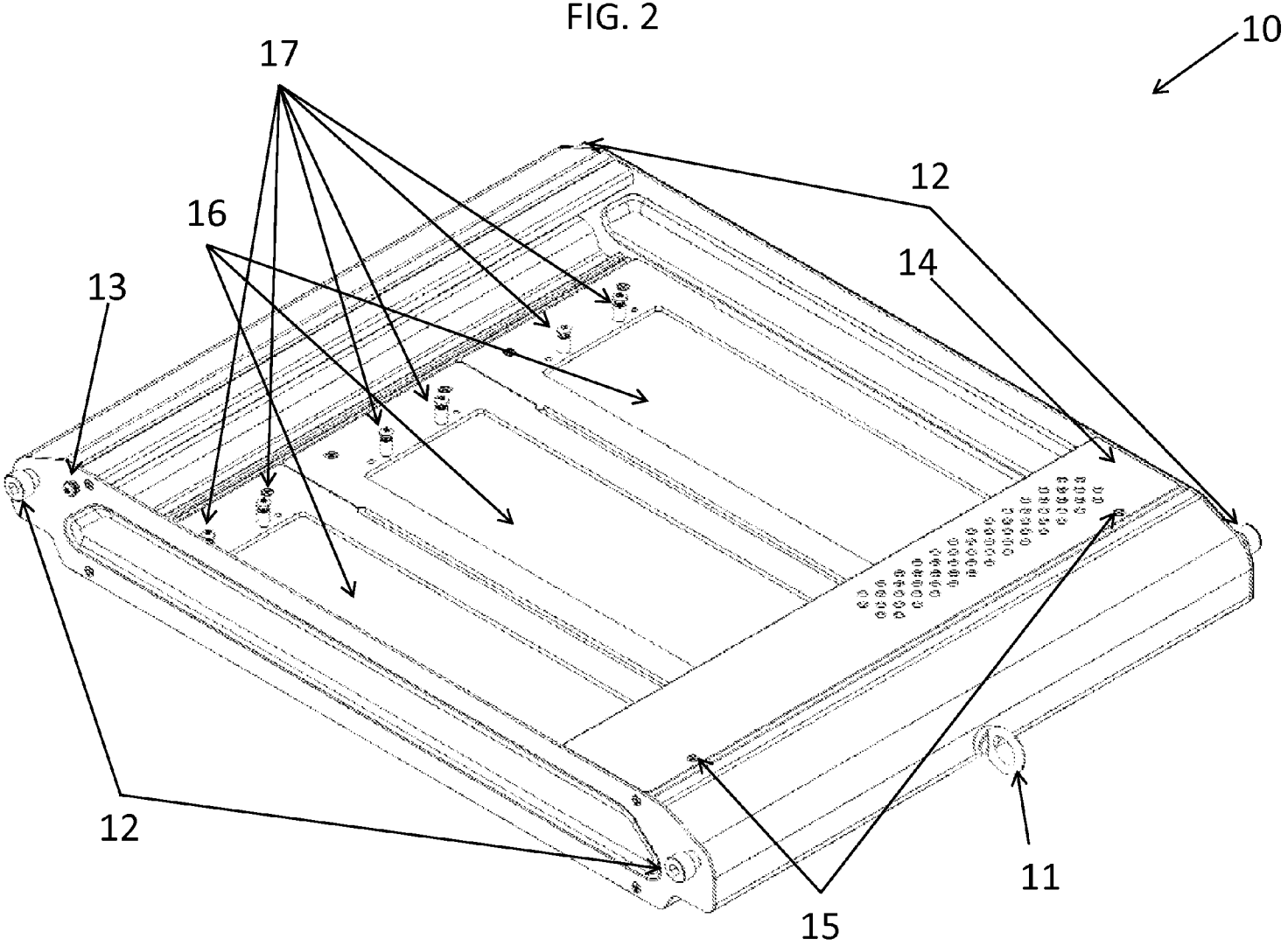
FIG. 2 illustrates a plan view example of a light fixture of a low bay lighting apparatus having dummy plates installed.
Figure 3:
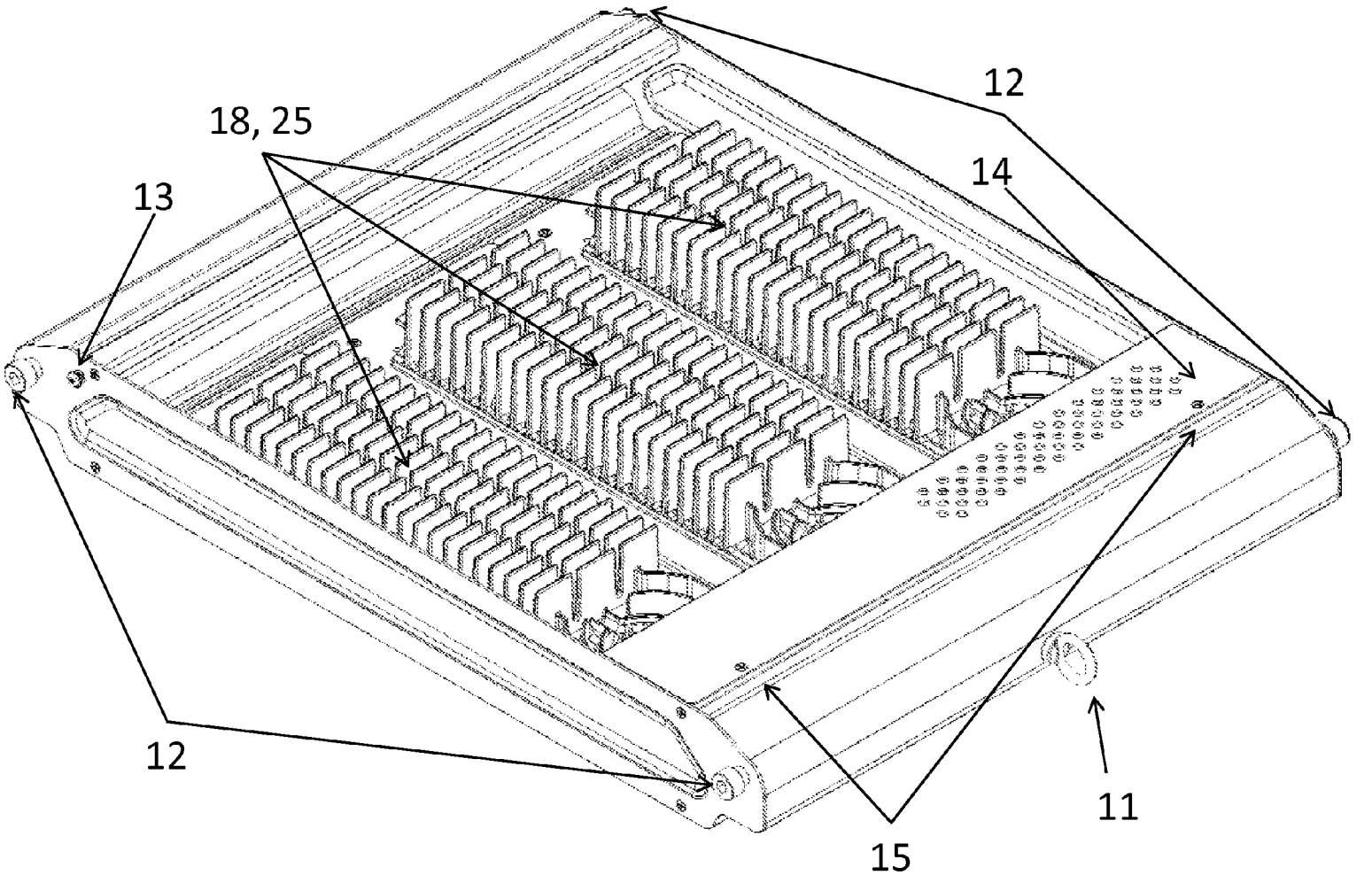
FIG. 3 illustrates a plan view example of a light fixture of a low bay lighting apparatus having lighting modules installed.

A low bay lighting apparatus 21 includes a mounting bracket 1 and a light fixture 10. The mounting bracket 1 and the light fixture 10 may be fabricated from any one of a number of different powder-coated metals. FIG. 1 illustrates a plan view example of the mounting bracket 1 of the low bay lighting apparatus 21. FIG. 2 illustrates a plan view example of the light fixture 10 of the low bay lighting apparatus 21 having dummy plates 16 installed. FIG. 3 illustrates a plan view example of the light fixture 10 of the low bay lighting apparatus 21 having lighting modules 18 installed. FIGS. 4-12 illustrate various examples of the low bay lighting apparatus 21, which includes the mounting bracket 1 and the light fixture 10.

Referring to FIG. 1 and portions of FIGS. 4-12, the mounting bracket 1 of the low bay lighting apparatus may include flush mount fastener receivers 2, mounting slots 3, a removable pendent pipe receiver 4, pendent pipe receiver fasteners 5, louvers 6, and mounting bracket locking fastener receivers 7, inverted T slots 8, and straight slots 9.

The mounting bracket 1 may be secured to any one of a ceiling, a mounting plate, a metal beam, an electrical box, and other equivalent elevated horizontal mounting surface on which a low bay lighting apparatus 21 would be mounted.

The flush mount fastener receivers 2 may be disposed on a flat top portion of the mounting bracket 1. The flush mount fastener receivers 2 may be used to mount the mounting bracket 1 flush against any elevated horizontal surface on which flush mounting of the mounting bracket 1 of a low bay lighting apparatus 21 may be achieved. The flush mount fastener receivers 2 are sealed shut unless flush mounting is required, in which case the flush mount fastener receivers 2 may be opened to receive fasteners to secure the mounting bracket to the surface being used for flush mounting.

The mounting slots 3 are patterned in a circular formation in a depressed area of the mounting bracket 1 that is surrounded by the flat top portion of the mounting bracket 1. The mounting slots 3 may enable mounting of the mounting bracket 1 to well-known ceiling electrical boxes.

The removable pendent pipe receiver 4 may be disposed at a center portion of the depressed area of the mounting bracket 1 that is surrounded by the mounting slots 3. When not in use, the removable pendent pipe receiver 4 may be removed by unfastening the pendent pipe receiver fasteners 5, which serve to secure the removable pendent pipe receiver 4 to the mounting bracket 1. The removable pendent pipe receiver 4 may enable mounting of the mounting bracket 1 to a threaded pipe or the like. A screw and a screw receiver (not shown) are provided in the removable pendent pipe receiver 4 in order to secure the threaded pipe.

The louvers 6 are provided on slanted portions of the mounting bracket 1 that surround the flat top portion of the mounting bracket 1. The louvers 6 may allow convection to ambient air of whatever heat might be generated in the low bay lighting apparatus 21.

The mounting bracket locking fastener receivers 7, the inverted T slots 8, and the straight slots 9 may be provided on opposing plates that hang vertically from the slanted portions. The inverted T slots 8 are disposed opposing each other at one end of the opposing plates. The inverted T slots 8 have an upside-down T form with a vertical portion of the upside-down T form being slanted away from the louvers 6.

The straight slots 9 are disposed opposing each other on the edge of the opposing plates at opposite ends of the opposing plates from the inverted T slots 8. The straight slots 9 have an opening that faces outward from the mounting bracket 1 and away from the inverted T slots 8. The mounting bracket locking fastener receivers 7 are disposed opposing each other on the ends of the opposing plates that include the straight slots 9.

Referring to FIGS. 2 and 3 and portions of FIGS. 4-12, the light fixture 10 may include a safety hook 11, posts 12, light fixture locking fasteners and fastener receivers 13, a power supply compartment 14, power supply compartment securing fasteners and fastener receivers 15, dummy plates 16, lighting module fasteners and fastener receivers 17, and lighting modules 18.

Referring to FIGS. 2-12, the posts 12 of the light fixture 10 are provided on the light fixture 10 at opposite ends of opposing outer side surfaces of the light fixture 10. The posts 12 on one opposing side of the light fixture 10 may be oriented facing away from the posts on the other opposing side of the light fixture 10. The posts 12 of the light fixture 10 are provided to mate with the respective inverted T slots 8 and straight slots 9 of the mounting bracket 1, thus serving to mate the light fixture 10 to the mounting bracket 1.

The safety hook 11 may be provided at an end of the light fixture 10 that corresponds with an end of the mounting bracket 1 that includes the inverted T slots 8. A safety wire (not shown) may attach the safety hook 11 to a secure position (not shown) to provide an added level of security with respect to the mating of the light fixture 10 to the mounting bracket 1.

The light fixture locking fasteners and fastener receivers 13 are located at an opposite end from the safety hook 11, on opposing outer portions of the light fixture 10, and to correspond with the mounting bracket locking fastener receivers 7 of the mounting bracket 1. The light fixture locking fastener and fastener receivers 13 may be used to lock a mating position of the light fixture 10 when mated to the mounting bracket 1. In other words, the light fixture locking fastener 13 may be inserted in the light fixture locking fastener receivers 13 and, subsequently, in the mounting bracket locking fastener receivers 7 to lock a mating position of the light fixture 10 when mated to the mounting bracket 1.

Specifically, when the posts 12 of the light fixture 10 are inserted into the respective inverted T slots 8 and straight slots 9 of the mounting bracket for mating purposes, the posts 12 are left unsecured due to the horizontal straight slots 9 and the horizontal portion of the inverted T slots 8. Further, the straight slots 9 are open at an end of the mounting bracket 1. Thus, if the posts 12 resting in the inverted T slots 8 are not positioned in the inverted T slots 8 near to the respective end of the mounting bracket 1, the posts 12 that are disposed in the straight slots 9 may subsequently fall out of the straight slots 9, resulting in an unwanted sudden rotation of the light fixture 10 due to an unwanted sudden rotation of the posts 12 disposed in the inverted T slots 8.

When light fixture locking fasteners are inserted into the light fixture locking fastener receivers 13 and the mounting bracket locking fastener receivers 7, the posts 12 resting in the inverted T slots 8 are in a locked position at the portion of the inverted T slots 8 nearest the respective end of the mounting bracket 1. Further, the posts 12 that are disposed in the straight slots 9 are prevented from falling out of the straight slots 9, and the posts 12 disposed in the inverted T slots are prevented from unwanted sudden rotation. Thus, a mating position of the light fixture 10 in the mounting bracket 1 is locked and maintained.

Figure 9:
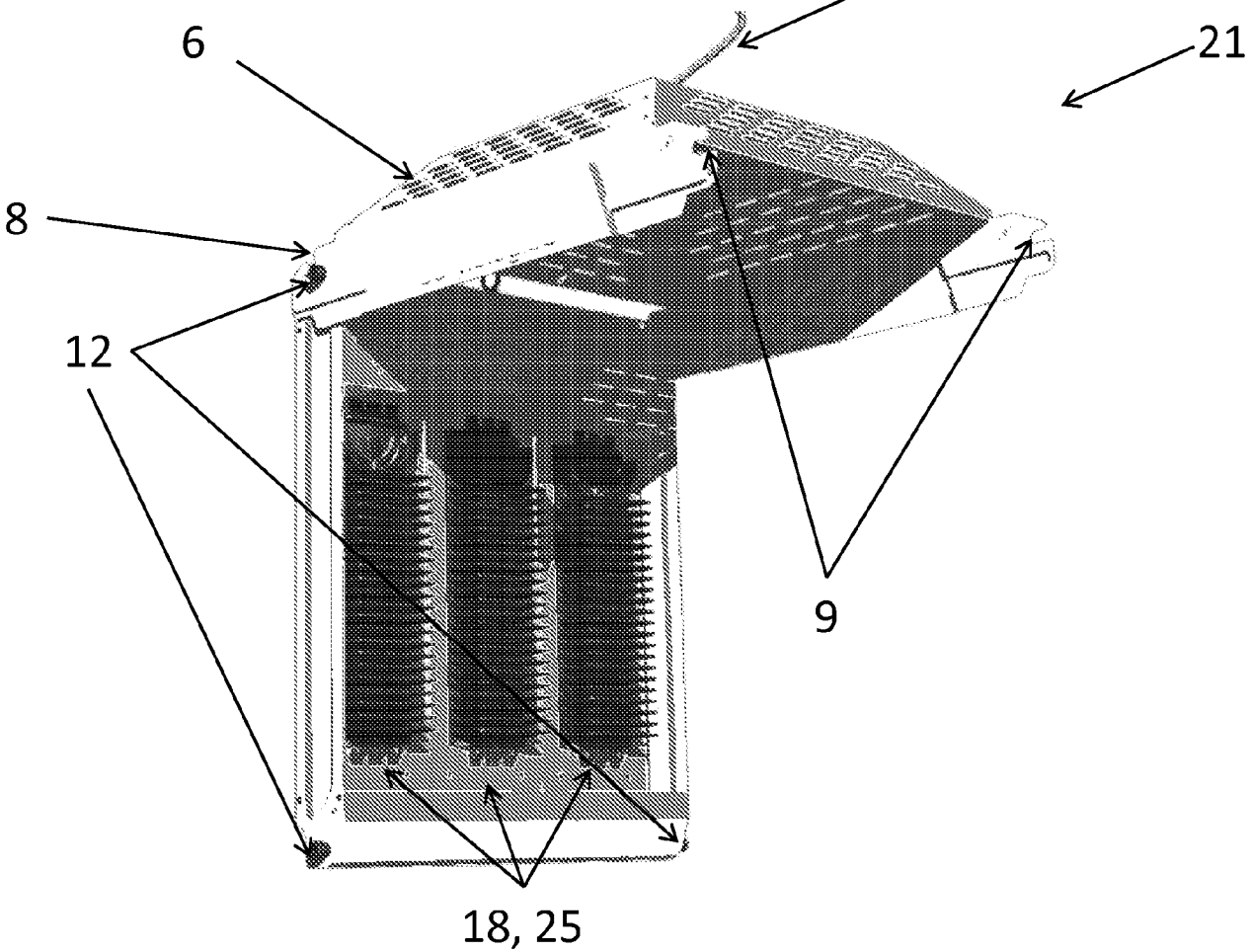
FIG. 9 illustrates additional plan view examples of a low bay lighting apparatus.

However, when the light fixture locking fasteners are removed from the light fixture locking fastener receivers 13, the posts 12 resting in the inverted T slots 8 may be slid in the inverted T slots 8 away from the respective end of the mounting bracket 1 purposefully in order to place the low bay lighting apparatus 21 in a maintenance orientation to hang freely, as is shown in FIG. 9. This may provide a low bay lighting apparatus 21 that allows maintenance without being overly concerned about the stability of the apparatus during maintenance and/or installation.

Specifically, the posts 12 disposed in the straight slots 9 fall out of the straight slots 9 when the posts 12 resting in the inverted T slots 8 are slid away from the respective end of the mounting bracket 1. Thus, the posts 12 resting in the inverted T slots 8 rotate, which results in the rotation of the light fixture 10 into a substantially vertical position that substantially forms a right angle with the mounting bracket 1. In this position, the low bay lighting apparatus 21 can be serviced.

A standard tool may be employed to remove the light fixture locking fasteners from the light fixture locking fastener receivers 13, and, subsequently, place the low bay lighting apparatus 21 in the above-referenced maintenance orientation, as is shown in FIG. 9.

In addition, the light fixture 10 may be secured from the maintenance orientation by rotating the posts 12 disposed in the inverted T slots 8 and the light fixture 10 upwards until the posts 12 disposed in the inverted T slots 8 can be slid to enable the posts 12 disposed opposite the inverted T slots 8 to rest in the straight slots 9. The light fixture locking fasteners may then be inserted in the light fixture locking fastener receivers 13 to lock a position of the light fixture 10 with respect to the mounting bracket 1, and, thus, lock a position of the low bay lighting apparatus 21.

Figure 7:
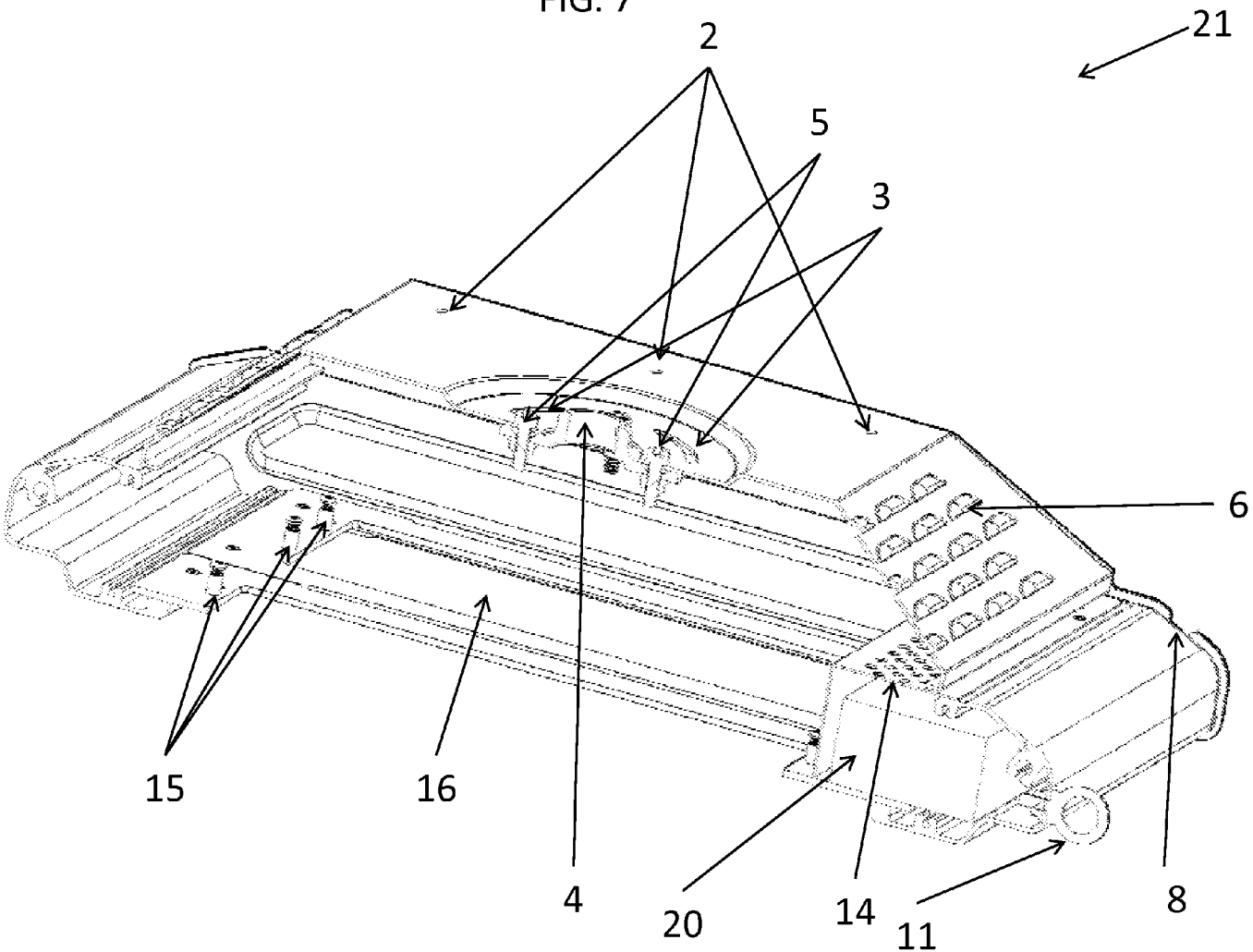
FIG. 7 illustrates a sectional view example of a low bay lighting apparatus.
Figure 8:
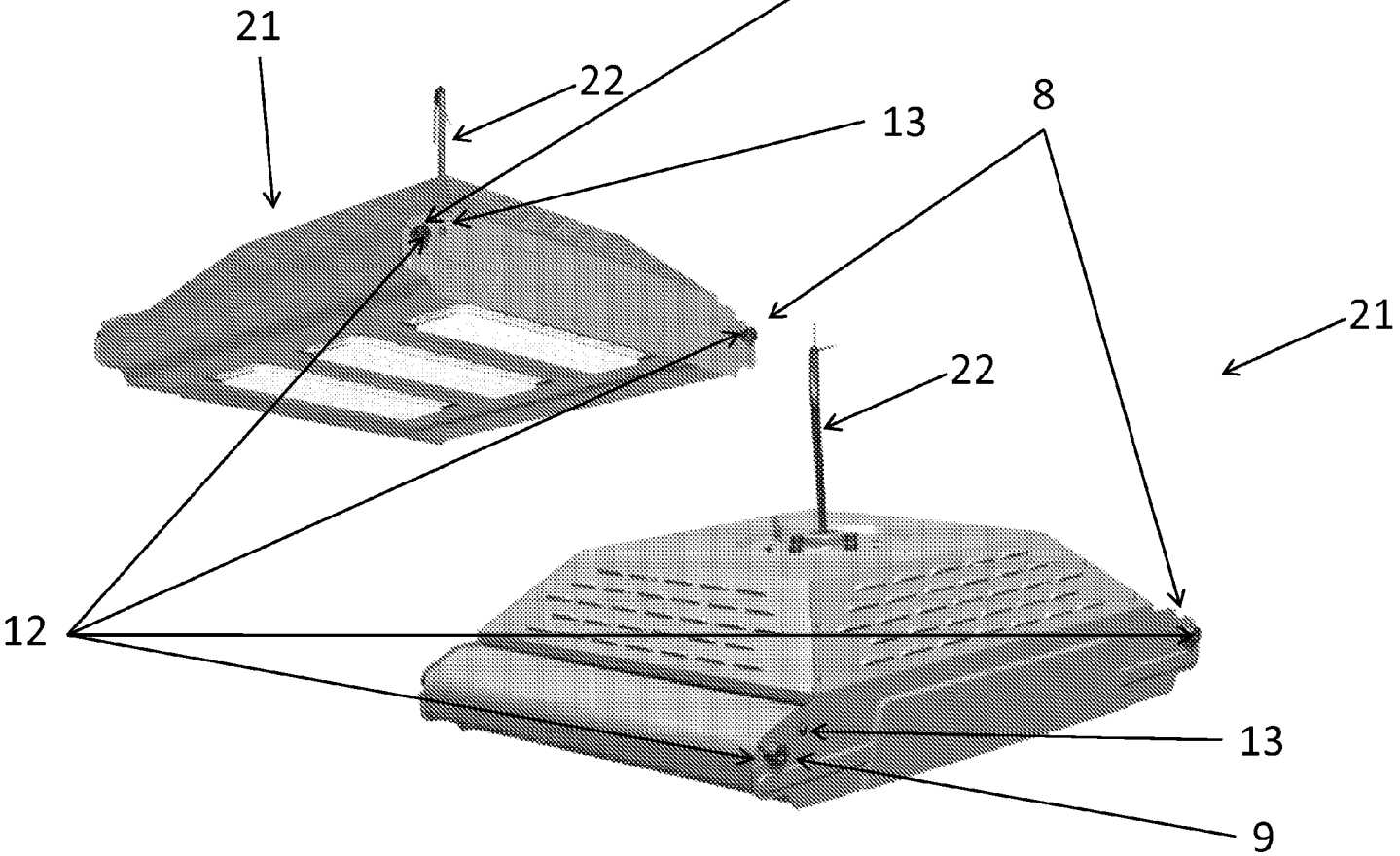
FIG. 8 illustrates additional plan view examples of a low bay lighting apparatus.

Further, referring to FIGS. 2, 3, and 7, a power supply compartment 14 is provided in the light fixture 10 that is configured to store a power supply 20. The power supply 20 is secured in the power supply compartment 14 using power supply compartment securing fasteners and fastener receivers 15. The power supply compartment securing fasteners may be removed in order to access the power supply 20 for maintenance purposes. The power supply 20 is also removable for maintenance or replacement.

Figure 4:
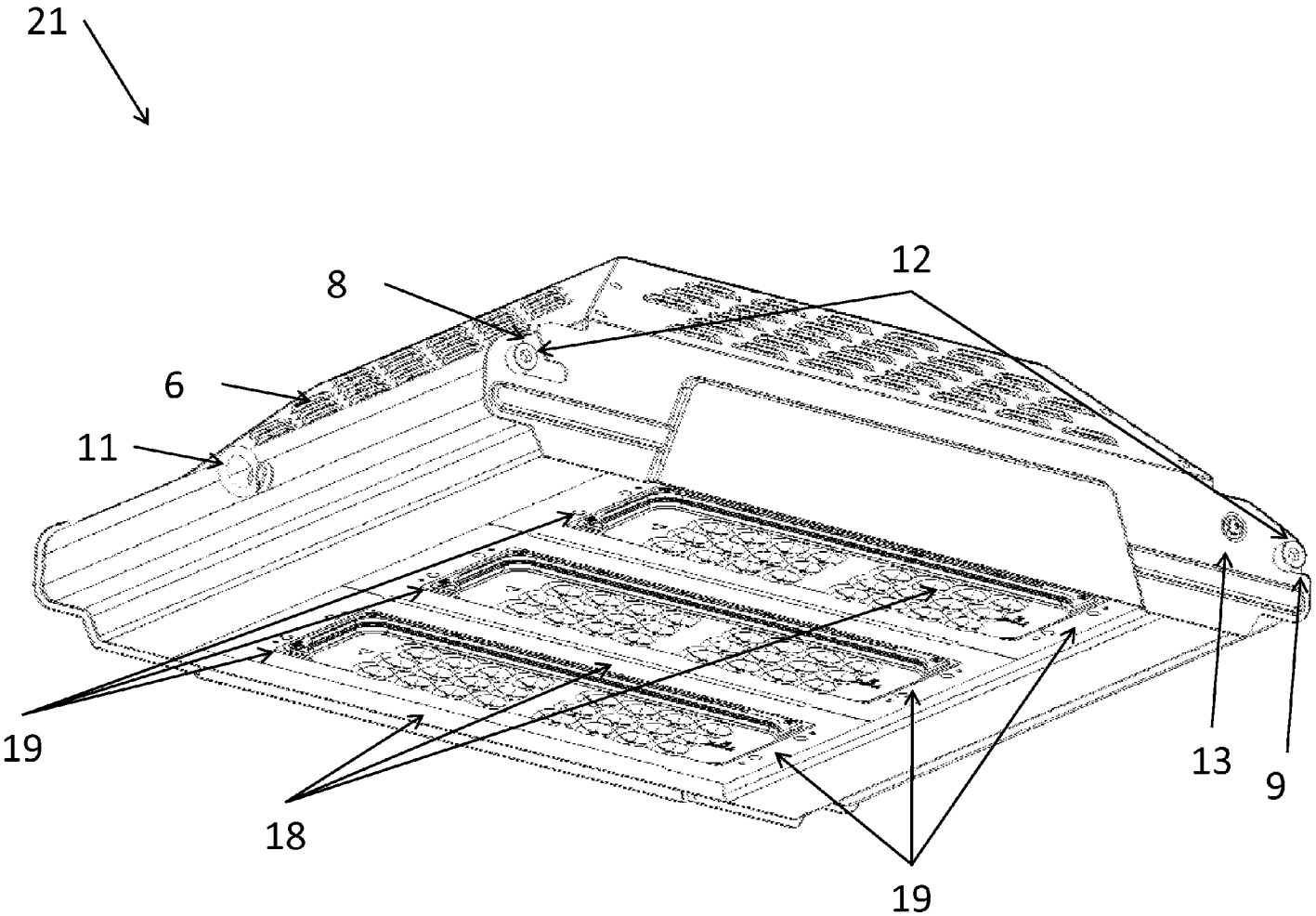
FIG. 4 illustrates a plan view example of a low bay lighting apparatus.
Figure 5:
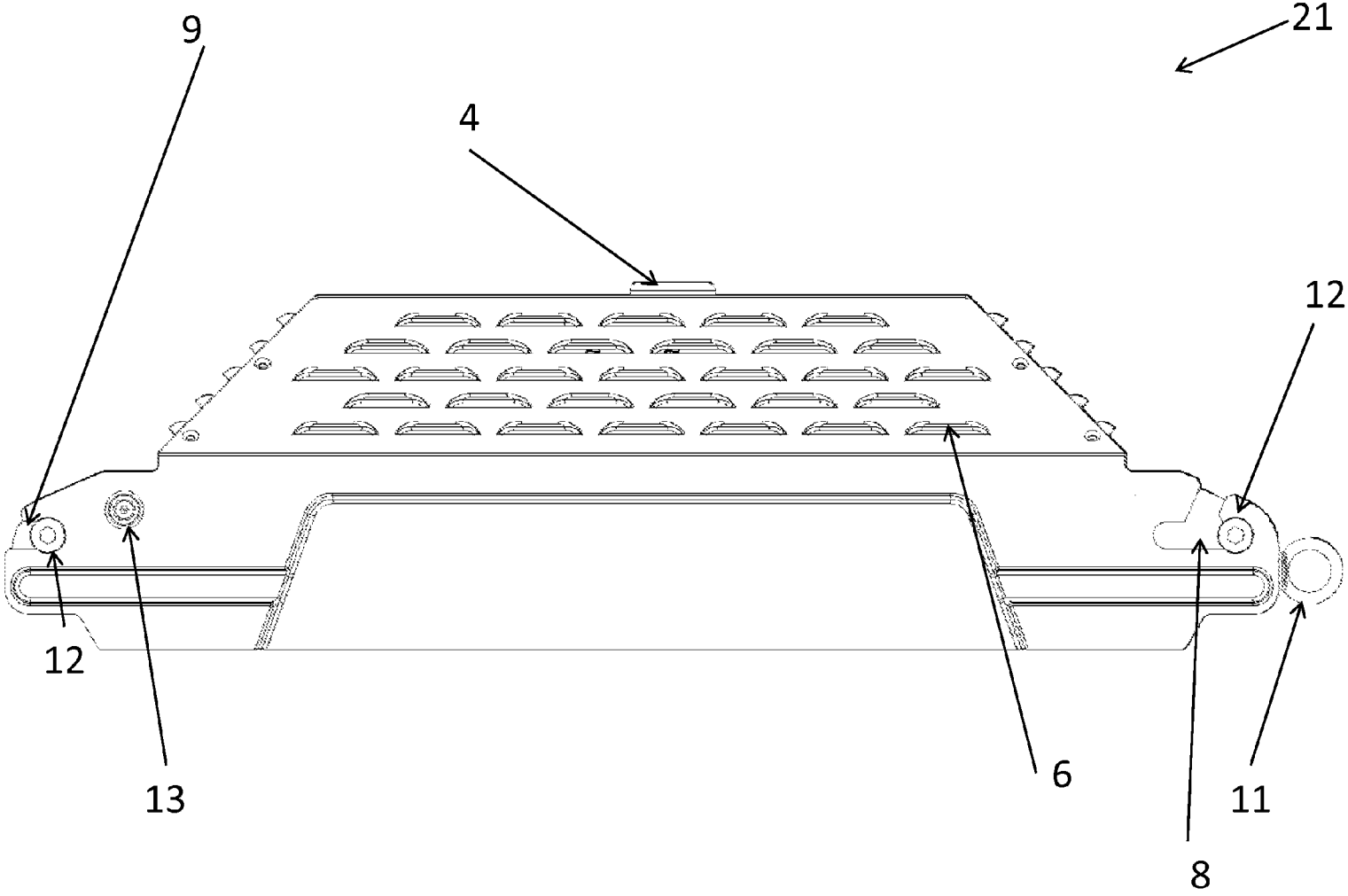
FIG. 5 illustrates a side view example of a low bay lighting apparatus.
Figure 6:
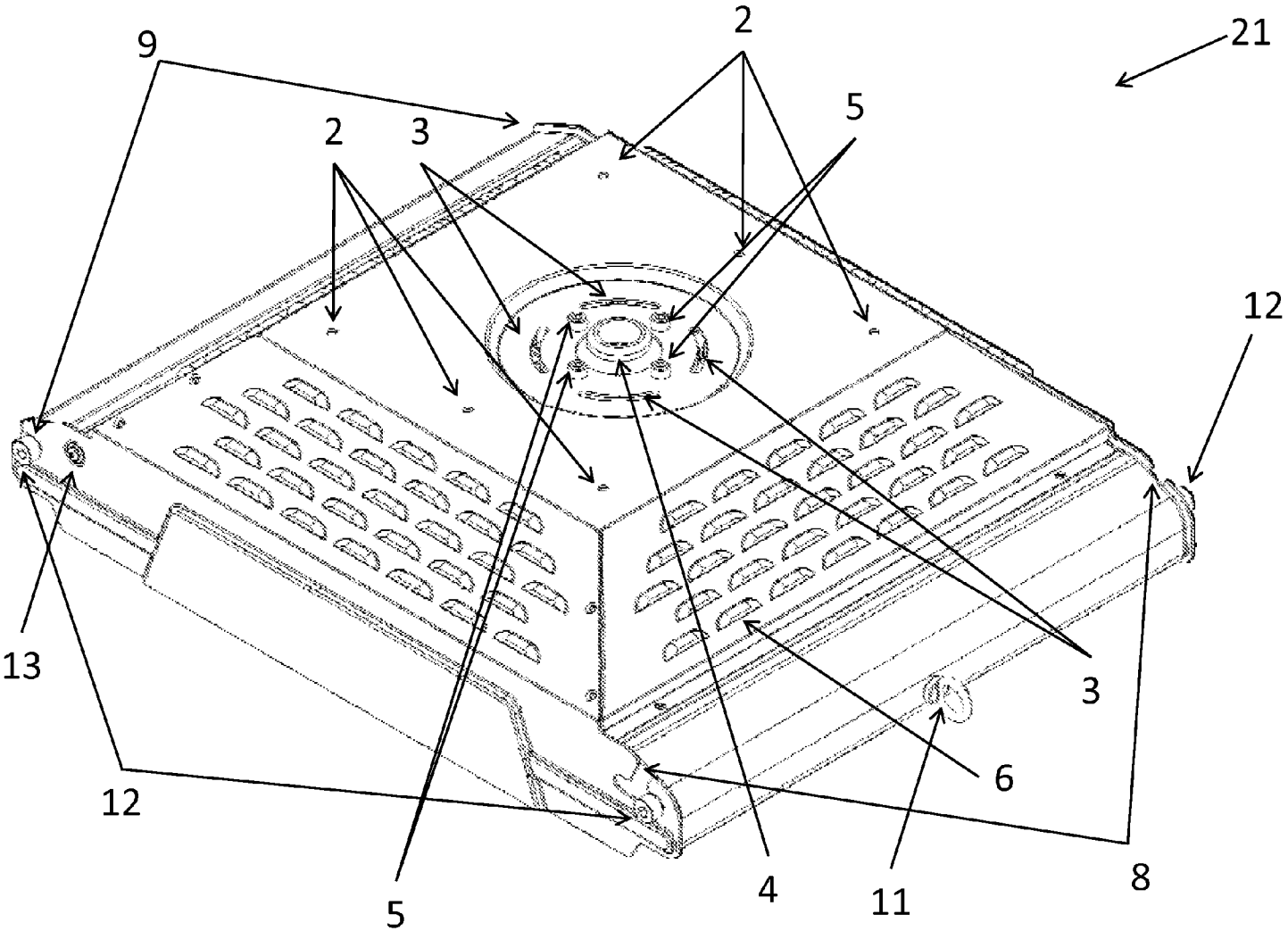
FIG. 6 illustrates another plan view example of a low bay lighting apparatus.

Referring to FIGS. 2 and 7, the light fixture 10 may include dummy plates 16 that are installed in the place of lighting modules 18 when the light that would accompany a lighting module 18 is not needed. Referring to FIG. 4, the light fixture 10 may include dummy plate fastener receivers 19 into which fasteners can be inserted to secure a dummy plate 16 to the light fixture 10.

Referring to FIGS. 3, 4, and 9-12, the light fixture 10 may include lighting modules 18 that can be removed or installed according to required lighting needs. The lighting modules 18 may be adapted for any type of lighting technology such that the lighting technology is acceptable for embodiment in the lighting modules 18, and the lighting modules 18 generated from the lighting technology are subsequently acceptable for embodiment in the low bay lighting apparatus 21.

One general aspect may provide that the lighting modules 18 are a collection of light emitting diodes (LEDs) disposed on a printed circuit board, an "LED brick", or the like. These aspects may provide a low bay lighting apparatus 21 that directs the principle light from the lighting modules 18 downward in an efficient manner to a desired illumination area. A clear top plastic cover may also be provided on a lighting surface of the lighting modules 18 to protect components of the lighting modules 18 and to function as a lens to manage light emitted from LEDs and direct the light emitted from the LEDs in a desirable manner.

Referring to FIGS. 8-12, the low bay lighting apparatus 21 may include a watertight power cord 22 that connects the low bay lighting apparatus 21 to a source of electricity. The watertight power cord 22 is connected to the power supply 20 via a watertight hand-operated electrical connector (not shown). The power supply 20 is further connected to the lighting modules 18 via watertight hand-operated electrical connectors (not shown). These watertight hand-operated electrical connectors may further allow installation and maintenance without tools or concern of electric shock. Further, the lighting modules 18 and the power supply 20 may be watertight as well.

All modular components of the low bay lighting apparatus 21, including the lighting modules 18, the power supply 20, the watertight power cord 22, and other miscellaneous wires, cords, and connectors, may be sealed to be watertight to a submergible rating of IP67. In addition, as technological advances occur, the low bay lighting apparatus 21 may be enabled to support revised, improved, and/or more efficient versions of the above-referenced modular components. These aspects may allow for easy installation, maintenance, and retrofitting compared with conventional low bay lighting units.

Further, in concert with the louvers 6 of the mounting bracket 1, the lighting modules 18 may be designed in order to provide efficient convection to ambient air of heat generated by the lighting modules 18. The lighting modules 18 may be further designed to promote efficient convection of heat to ambient air by being constructed of heat conducting material or by including heat sinks 25, shown in FIGS. 3 and 9, directly coupled to the lighting modules 18.

Referring to FIGS. 2 and 7, the lighting modules 18 may be secured to the light fixture 10 using lighting module fasteners and fastener receivers 17. The lighting modules 18 secured to the light fixture by the lighting module fasteners 17 may be removed by orienting the light fixture 10 in the above-referenced maintenance orientation, utilizing a common tool to remove the lighting module fasteners 17 from the lighting module fastening receivers 17, and disconnecting the lighting modules 18 being removed from the watertight hand-operated electrical connectors (not shown) provided to connect the lighting modules 18 to the power supply 20.

Figure 10:
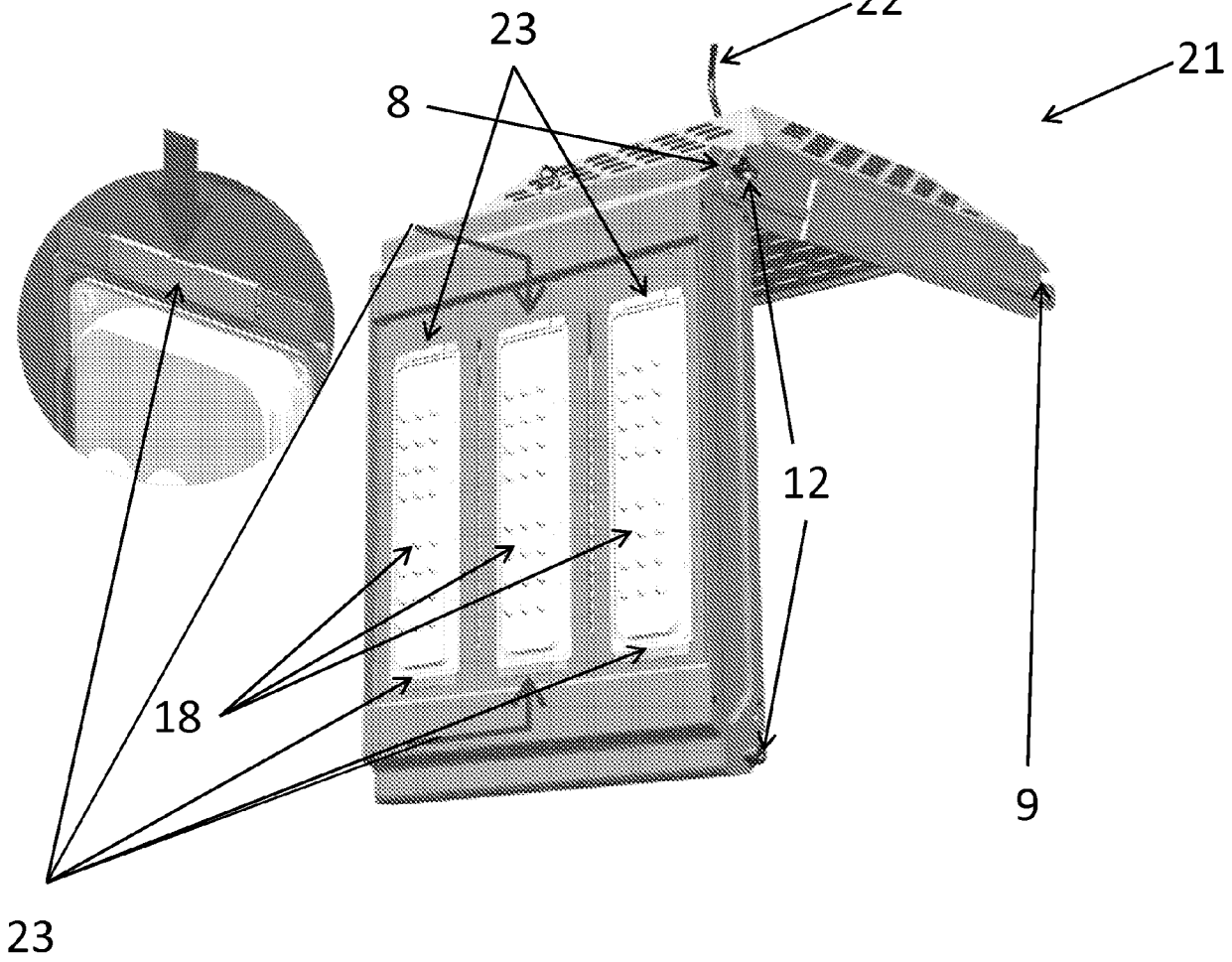
FIG. 10 illustrates another plan view example of a low bay lighting apparatus.
Figure 11:
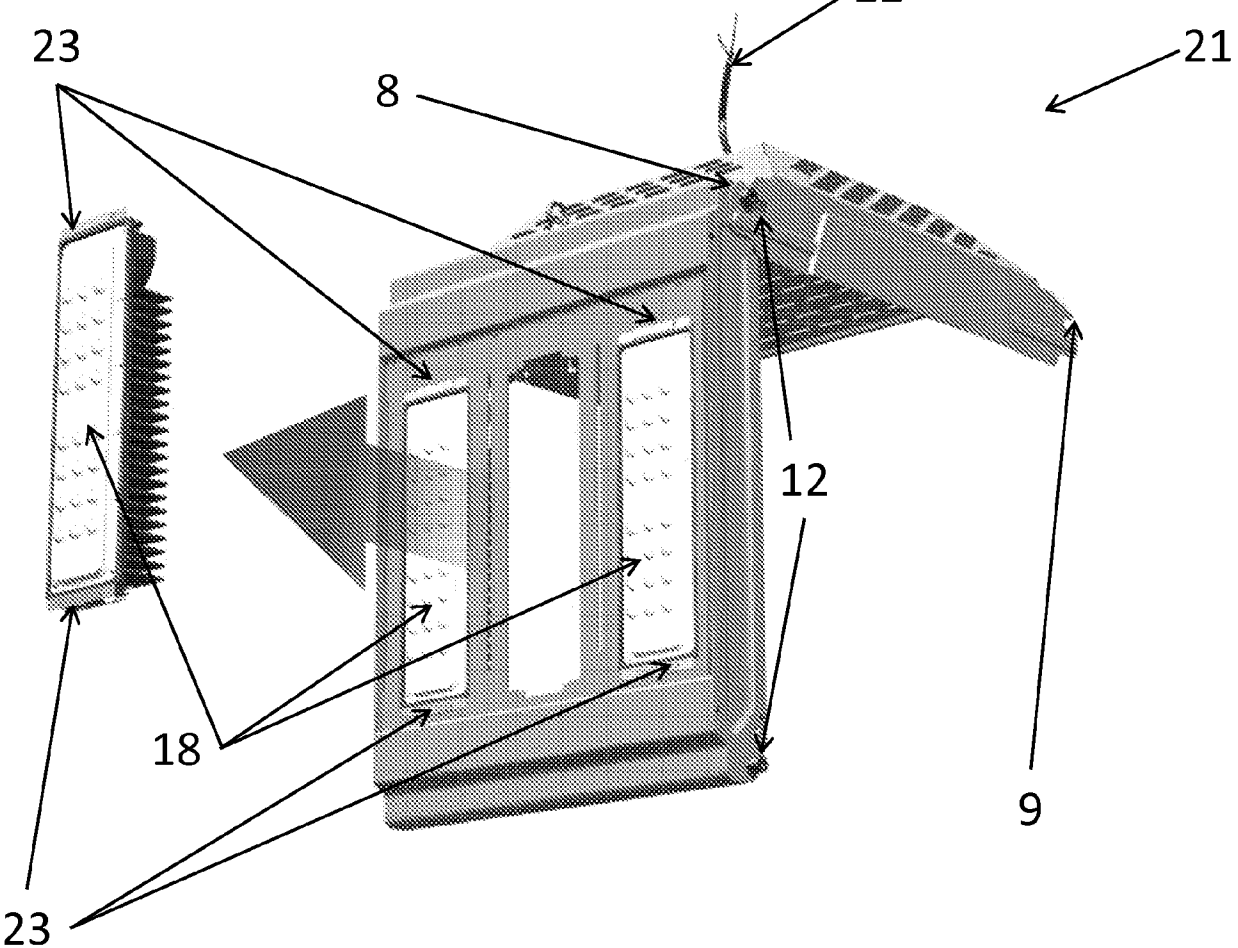
FIG. 11 illustrates another plan view example of a low bay lighting apparatus.
Figure 12:
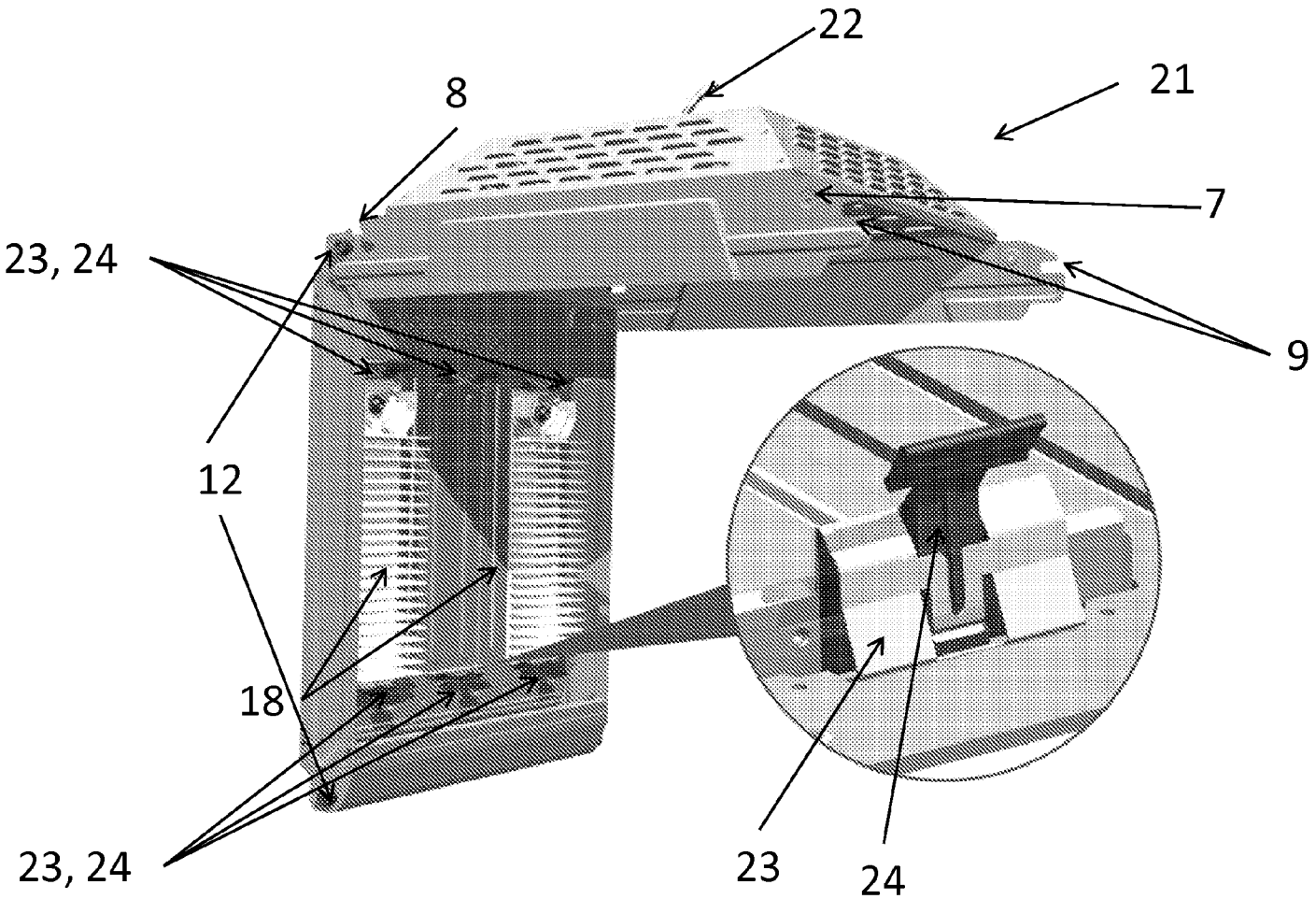
FIG. 12 illustrates another plan view example of a low bay lighting apparatus.

Referring to FIGS. 10-12, the lighting modules 18 may be secured to the light fixture 10 using spring clips 23. After connecting the lighting modules 18 to the power supply 20 via the watertight hand-operated electric connectors, the spring clips 23 may be used to physically couple the lighting modules 18 to the light fixture 10 without the use of tools. Further, the spring clips 23 can be pressed to remove the lighting modules 18 without placing the low bay lighting apparatus 21 in maintenance orientation. The lighting modules 18 may then be disconnected from the power supply 20 via hand and without concern of electric shock by disconnecting the lighting modules 18 from the watertight hand-operated electrical connectors. In addition, referring to FIG. 12, mating locking clips 24 may be inserted into the spring clips 23 to provide a secure lock and prevent unwanted removal or theft of the lighting modules 18.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A low bay lighting apparatus, comprising:

a light fixture comprising a modular light source configured to illuminate areas disposed beneath the light fixture, a modular power supply configured to provide power to the modular light source, and first posts and seconds posts respectively disposed on opposing sides of the light fixture, wherein the modular light source comprises a plurality of modular light emitting diode (LED) boards disposed in the light fixture, the plurality of modular LED boards comprising a plurality of spring clips respectively configured to secure the modular LED boards to the light fixture without using tools and to be individually pressed to release a respective modular LED board from the light fixture, the modular power supply being configured to supply power to the plurality of modular LEI) boards, and the modular power supply and the plurality of modular LED boards being sealed and watertight; and a mounting bracket to be secured to an elevated horizontal surface, the mounting bracket comprising first slots and second slots respectively disposed on opposing sides of the mounting bracket and which are configured to mate respectively with the plurality posts on opposing sides the light fixture to removably secure the light fixture to the mounting bracket, wherein, after the mounting bracket is secured to the elevated surface, the light fixture is configured to be lifted and the first posts on a first side of the light fixture are configured to be inserted into the corresponding first slots arranged on a first side of the mounting bracket without the use of tools, and the light fixture is configured to freely hang from the first side of the mounting bracket after the insertion such that an interior of the light fixture is exposed.

2. The apparatus of claim 1, wherein the plurality of spring clips are further configured to secure the plurality of lighting modules to and release the plurality of lighting modules from an outer periphery of the light fixture.

3. The apparatus of claim 1, further comprising:

a plurality of mating locking clips configured to prevent the plurality of spring clips from being operated to release the plurality of lighting modules from the light fixture when the mating locking clips are inserted into the spring clips.

4. The apparatus of claim 1, wherein the first slots on the first side of the mounting bracket comprise a plurality of inverted T slots disposed on one end of opposing outer side surfaces of the mounting bracket, each of the plurality of inverted T slots being configured to:

accept a first post through a vertically slanted opening of the inverted T slots without the use of tools;

enable slidable adjustment without ability to exit the inverted T slots unless lifted and against gravity and resting of the first post on a horizontal portion of the inverted T slots; and support the first post to enable the light fixture to freely hang from the horizontal portion of the inverted T slots.

5. The apparatus of claim 4, wherein the second slots comprises a plurality of straight slots disposed on an opposite end of the opposing outer side surfaces of the mounting bracket from the plurality of inverted T slots, each of the plurality of straight slots being configured to:

accept a second post of the light fixture through a vertical opening of the straight slot without the use of tools, the vertical opening being disposed at a horizontal edge portion of the other end of the opposing outer side surfaces of the mounting bracket;

enable slidable adjustment and resting of the second post on a horizontal portion of the straight slot; and support the second post to enable the light fixture to be supported horizontally by the first slots and the second slots.

6. The apparatus of claim 5, wherein the light fixture and the mounting bracket further comprise one or more locking fastener receivers configured to accept a fastener to prevent the plurality of posts from sliding in the plurality of slots, the locking fastener receivers of the light fixture having a location that corresponds with a location of the locking fastener receivers of the mounting bracket.

7. The apparatus of claim 1, further comprising:

a watertight hand-operated power cord configured to supply the modular power supply with electricity; and a watertight hand-operated connection cord configured to connect the modular light source to the modular power supply and enable a disconnection of the modular light source from the modular power supply while modular power supply is being supplied with electricity.

8. The apparatus of claim 7, wherein the watertight hand-operated power cord, the watertight hand-operated connector cord, the modular power supply, and the modular light source are configured to be water tight to a submergible rating of IP67.

9. The apparatus of claim 1, wherein the modular light source is further configured to be removed without terminating a supply of electricity to the modular power source.

10. A low bay lighting apparatus, comprising:

a mounting bracket configured to be installed at an elevated horizontal position, the mounting bracket comprising first slots and second slots respectively disposed on opposing sides of the mounting bracket;

a light fixture configured to be lifted up and inserted to hang from one end of the mounting bracket after the mounting bracket has been installed, the light fixture comprising first posts and second posts respectively disposed on opposing ends of the light fixture and which are configured to mate with the first slots and the second slots of the mounting bracket without the use of tools to secure the light fixture to the mounting bracket;

a plurality of modular light emitting diode (LED) boards disposed in the light fixture, the plurality of modular LED boards comprising a plurality of spring clips respectively configured to secure the modular LED boards to the light fixture without using tools and to be individually pressed to release a respective modular LED board from the light fixture; and a modular power supply installed in the light fixture and configured to supply power to the plurality of modular LED boards, the modular power supply and the plurality of modular LED boards being sealed and watertight, wherein, when the first posts of the light fixture are mated with the corresponding first slots of the mounting bracket while the second posts of the light fixture are not mated with corresponding second slots of the mounting bracket, each first post is configured to:

rotate in the first slot, and support the light fixture in a freely hanging position that is substantially perpendicular to a position of the mounting bracket.

11. The apparatus of claim 10, wherein the mounting bracket further comprises a plurality of louvers configured to convect heat generated by the light fixture into ambient air outside of the low bay lighting apparatus.

12. The apparatus of claim 10, further comprising:

a watertight hand-operated power cord configured to connect the modular power supply to a source of electricity; and a plurality of watertight hand-operated connector cords configured to supply the plurality of modular LED boards with power from the modular power supply, wherein the watertight power cord and the plurality of watertight connector cords are further configured to:

prevent water damage to the plurality of modular LED boards and the modular power supply; and allow connection to and disconnection from the modular power supply and the plurality of modular LED boards without using tools or termination of the source of electricity.

13. The apparatus of claim 10, further comprising:

a plurality of mating locking clips configured to lock the plurality of spring clips when inserted in the spring clips.

14. A low bay lighting apparatus, comprising:

a light fixture;

a lighting module removably secured to the light fixture, the lighting module comprising one or more light emitting diodes (LEDs) and spring clips configured to attach the lighting module to the light fixture without using tools and to release the lighting module from the light fixture in response to at least one of the spring clips being pressed by a user;

a modular power supply installed in the light fixture and configured to supply power to the lighting module, the modular power supply and the lighting module being sealed and watertight;

firsts posts and second posts disposed respectively on opposite sides of the light fixture; and a mounting bracket to be secured to an elevated horizontal surface, the mounting bracket comprising first slots and second slots disposed respectively on opposing sides of the mounting bracket and which are configured to mate respectively with the first posts and the second posts to removably secure the light fixture to the mounting bracket after the mounting bracket has been installed in the elevated horizontal surface.

15. The apparatus of claim 14, wherein the spring clips are further configured to secure the lighting module to and release the lighting module from an external periphery of the light fixture.

16. The apparatus of claim 15, further comprising:

mating locking clips configured to mate with portions of the spring clips disposed in an internal periphery of the light fixture to prevent operation of the spring clips to release the lighting module to an external periphery of the light fixture.

17. The apparatus of claim 16, wherein the mating locking clips mate with the portions of the spring clips disposed in the internal periphery of the light fixture when the light fixture is freely hanging from a pair of the slots respectively via a pair of the posts disposed at one of the opposite ends of the opposing outer side surface of the light fixture.

* * * * *